United States Patent [19]

Hara et al.

[11] Patent Number: 4,974,032

[45] Date of Patent: Nov. 27, 1990

[54] PAPER SEPARATION CHARGER FOR USE IN ELECTROPHOTOGRAPHIC COPIER AND THE LIKE

[75] Inventors: Kazuyoshi Hara; Masataka Oda, both of Osaka, Japan

[73] Assignee: Minolta Camera Kabushiki Kaisha, Osaka, Japan

[21] Appl. No.: 262,738

[22] Filed: Oct. 12, 1988

[30] Foreign Application Priority Data

Oct. 16, 1987 [JP] Japan ..... 62-262339

[51] Int. Cl.[5] ..... G03G 21/00

[52] U.S. Cl. ..... 355/315; 271/307

[58] Field of Search ..... 355/225, 315; 271/307, 271/310, 900

[56] References Cited

U.S. PATENT DOCUMENTS

| | | | |
|---|---|---|---|
| 3,527,941 | 9/1970 | Culhane et al. | 355/225 X |
| 4,183,653 | 1/1980 | Satomi et al. | 355/315 |
| 4,320,956 | 3/1982 | Nishikawa et al. | 355/225 |
| 4,443,095 | 4/1984 | Tsushima et al. | 355/315 X |
| 4,445,772 | 5/1984 | Aoki et al. | 355/225 X |
| 4,542,977 | 9/1985 | Kamogawa et al. | 355/315 |
| 4,669,861 | 6/1987 | Nukushina et al. | 355/272 |
| 4,835,571 | 5/1989 | Tagawa et al. | 355/315 X |
| 4,876,578 | 10/1989 | Hara et al. | 355/315 |

FOREIGN PATENT DOCUMENTS

| | | |
|---|---|---|
| 2930701 | 1/1981 | Fed. Rep. of Germany . |
| 58-120282 | 7/1983 | Japan . |
| 62-91649 | 6/1987 | Japan . |

*Primary Examiner*—Fred L. Braun

*Attorney, Agent, or Firm*—Wenderoth, Lind & Ponack

[57] ABSTRACT

A paper separation charger for separating paper from a photosensitive member in electrophotographic copiers and the like including a grid member disposed between a corona wire and the photosensitive member. The grid member has an aperture efficiency which is varied in the direction perpendicular to the direction of transport of paper.

12 Claims, 2 Drawing Sheets

PAPER SEPARATION CHARGER FOR USE IN ELECTROPHOTOGRAPHIC COPIER AND THE LIKE

FIELD OF THE INVENTION

The present invention relates to a paper separation charger for use in electrophotographic copiers and the like, and more particularly relates to a scorotron type charger grid configuration.

BACKGROUND OF THE INVENTION

In electrophotographic copiers, an image formed on the photosensitive drum is transferred to the copy paper by means of a transfer charger. Thereafter, the paper is separated from the drum by means of a well known corona charger used as a separation device. Japanese Laid-Open Patent Application SHO No. 58-120282 discloses a scorotron charger used as a separation charger, the scorotron charger having a grid electrode interposed between a corona wire and the object to be charged, and which controls the amount of charge by controlling the voltage applied to the grid.

In general, paper transported via a fixing device of a copying apparatus is somewhat curled. Particularly, paper tends to curl more greatly at both its ends than at its central portion in a direction perpendicular to the paper transport direction. When the paper is re-fed with both its ends curling towards a photosensitive member in a duplex or a composite copy mode, an excellent separability cannot be obtained at the curling portion. As a result, a separation charger is operated to discharge an excessive amount of charge for completely separating the paper. Accordingly, toner once deposited onto the paper is again transferred to the photosensitive member, producing a phenomenon in which a part of an image on the copy paper is lost (This phenomenon is hereinafter referred to as a "mark").

SUMMARY OF THE INVENTION

A main object of the present invention is to provide a superior scorotron type separation charger.

A further object of the present invention is to provide a scorotron type separation charger with improved separation characteristics.

These and other objects of the invention can be accomplished by providing a scorotron charger having a grid formed so as to possess an aperture efficiency variable in the direction perpendicular to the direction of transport of paper.

These and other objects or features of the present invention will become apparent from the following description of the preferred embodiments thereof taken in conjunction with the accompanying drawings.

BRIEF DESCRIPTION OF THE DRAWINGS

In the following description, like parts are designated by like reference numbers throughout the several drawings.

DETAILED DESCRIPTION OF THE PREFERRED EMBODIMENTS

Preferred examples of the separation charger of the present invention for use in electrostatic copy machines are described hereinafter with reference to the accompanying drawings.

First Embodiment

Figure 1:
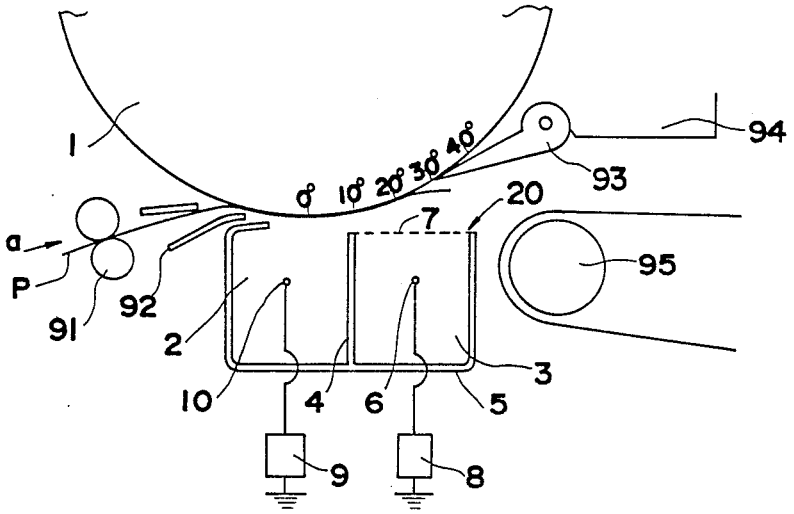
FIG. 1 is a plan view showing a transfer separation section of a copying apparatus according to the first embodiment of the invention.
Figure 2:
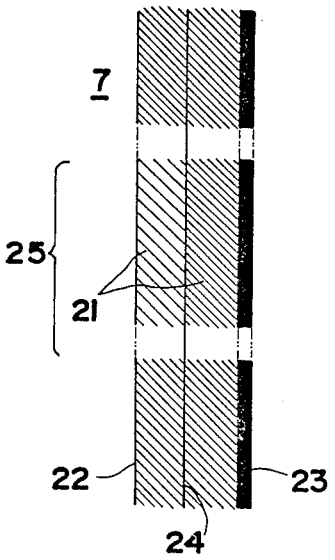
FIG. 2 is a top view showing a grid configuration of a first embodiment.

FIG. 1 shows a simplified view of the essential portion of the separation charger of the present invention, and FIG. 2 shows a top view of the grid portion of the same embodiment. Copy paper is transported in the direction shown by an arrow a in FIG. 1.

A transfer separation section comprises a photosensitive member 1 which carries a toner image developed by a developing means not shown in the drawing, and a transfer charger 2 and scorotron separation charger 3 which are disposed opposite to the photosensitive member 1. The remaining elements surrounding the photosensitive member 1, that is, a transport roller 91, guide panel 92, separating pawl 93, cleaner 94, discharge device 95 and the like, are identical to well known components of conventional copying apparatuses. Therefore, the detailed explanation of these components is omitted here.

The scorotron separation charger 3 of the present invention has a housing 5, to which the transfer charger 2 is integrally united through a center partition 4 so as to form a single unit, a charge electrode 6 and a grid 7. The charge electrode 6 of the separation charger 3 has connected thereto a DC high voltage transformer 8 of a positive polarity for separation and a charge electrode 10 of the transfer charger 2 has connected thereto a high voltage transformer 9 of a negative polarity for a transfer operation. The housing 5 may also be manufactured as separate units and then conjoined, rather than as a single unit and mounted to the body of the copying apparatus (not shown in the drawing), as in the present embodiment.

A grid 7 which covers an aperture portion 20 of the scorotron separation charger 3 is produced by an etching process using a stainless steel plate as a material. The grid 7 is fixed to a hook-like latch portion (not shown) which is provided at both ends of the housing 5 in the longitudinal direction, whereby the grid 7 is bridged at a predetermined height.

As shown in FIG. 2, the grid 7 is formed with the parallel wire lines 21 arranged with an inclination of 45° relative to the paper transport direction and reinforcement wire lines 22, 23 and 24 arranged in the direction perpendicular to the paper transport direction.

The grid 7 has an aperture efficiency greater at the portion 25 which is the upstream side of the reinforcement wire line 24 with respect to the paper transport direction as well as the central portion of the grid 7 with respect to the direction perpendicular to the paper transport direction than at the other portions. As is apparent from the above, the aperture efficiency at the portion 25, which is the upstream side of the reinforcement wire line 24 with respect to the paper transport direction, is set greater than at the other portions for obtaining excellent separability. By this construction, the separation is started at about 15° to 20° at the downstream side with respect to the paper transport direction, supposing that the portion where a hypothetical line from guide panel 92 to a transport belt 95 of the discharge device 95 is in contact with the photosensitive member 1 is set to 0°.

In this embodiment, the grid 7, the entire width of which is 21 mm in the paper transport direction, has wire lines 21 and 24 each having a width of 0.1 mm, wire line 22 having a width of 0.5 mm and wire line 23 having a width of 2 mm. The reinforcement wire line 24 is positioned at 9 mm from the upstream end of the grid 7 in the paper transport direction. The central portion 25 where the aperture efficiency is greater than the other portions has a length of about 160 mm in the direction perpendicular to the paper transport direction. The wires 21 are spaced with an interval of 2 mm in the central portion 25, while in the other portions, the wires 21 are spaced with an interval of 1 mm.

The copying apparatus adopting the paper separation charger according to the present invention is subjected to a first experiment in which a composite copy operation is performed with the use of A4 size paper for checking the separability and the ratio of generation of the mark phenomenon. The paper used in the first experiment has a weight of about 64 g/m$^2$. Further, the paper has paper fibers, most of which lie in the longitudinal direction of the paper. This experiment is carried out by transporting such a paper in the direction perpendicular to the longitudinal direction of the paper. A white chart is employed as an original to be copied on a paper by the first copying operation, while the original to be copied on the same surface of the paper by the second copying operation has words of 6% relative to the white chart.

As a result of the first experiment, it was observed that the paper re-fed after the first copying operation was somewhat curled towards the photosensitive member. Although the charge wire of the separation charger was connected to the DC high voltage transformer of the positive polarity as mentioned above, an AC high voltage transformer may be used for obtaining the same effect. Moreover, the charge wire of the separation charger was applied with a voltage every 0.5 kV within the range of 4.0 kV to 6.5 kV.

Figure 3:
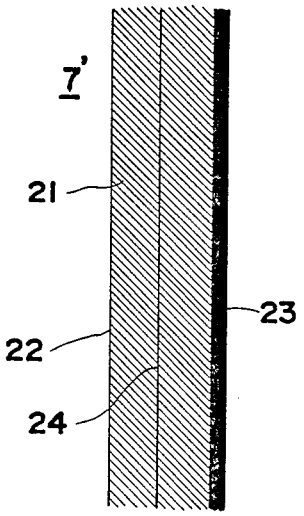
FIG.3 (PRIOR ART)
FIG. 3 is a top view showing a conventional grid configuration for the purpose of comparison.

Subsequently, a comparative experiment was performed by using a copying apparatus identical with that of the above first experiment except that the grid 7 was substituted for a grid 7' shown in FIG. 3. All wire lines 21 of the grid 7' were uniformly spaced with an interval of 1 mm.

The occurrence of the "mark" was determined in the central portion and edge portion of the paper. The result was shown in Table 1 in which "Y" represents the occurrence of the "mark" and "N" represents the absence of the same. Moreover, the separability was evaluated according to the mark made on the paper by the separating pawl or the stains made on the paper by the contact with the bottom of the cleaner. The separability was determined to be excellent (represented as "E" in Table 1) when there is no marks or stains on the paper, or to be bad (represented as "B" in Table 1) when the paper has some marks or stains thereon.

TABLE 1

| Type | Grid 7' | | | Grid 7 | | |
|---|---|---|---|---|---|---|
| | Mark | | Separa- | Mark | | Separa- |
| $V_T$(KV) | Center | Edge | bility | Center | Edge | bility |
| 4.0 | N | N | B | N | N | B |
| 4.5 | N | N | B | N | N | B |
| 5.0 | N | N | B | N | N | E |
| 5.5 | N | Y | B | N | N | E |
| 6.0 | N | Y | E | Y | Y | E |
| 6.5 | Y | Y | E | Y | Y | E |

Table 1 shows that the grid 7 applied with the voltages of 5.0 and 5.5 KV was excellent in separability without "mark" phenomenon. In this case, the amount of charges reaching the reverse side of the paper at the central portion of the grid 7, i.e., the portion having a greater aperture efficiency is more than that at the central portion of the grid 7'. In general, the "mark" is more likely to occur at the central portion than at the edge portion of the grid 7 in the case of applying the same voltage to the central and edge portions. However, the grid 7 has a great amount of discharge, resulting in that the excellent separability can be obtained and the copy image is free from "mark". Further, the separability at the edge portion of the grid 7 becomes excellent according to the excellent separability at the central portion, with the result that the "mark" is less prone to occur.

Second Embodiment

The basic construction of the second embodiment is identical to that of the first embodiment except for the configuration of the grid attached to the opening portion 20 of the scorotron charger and the mesh pattern of the wire lines. More specifically, a second experiment the same as the first experiment was carried out with the use of the grid 70 shown in FIG. 4. Further, the comparative experiment was executed by using the grid 70' shown in FIG. 5 as the substitution of the grid 70.

Figure 4:
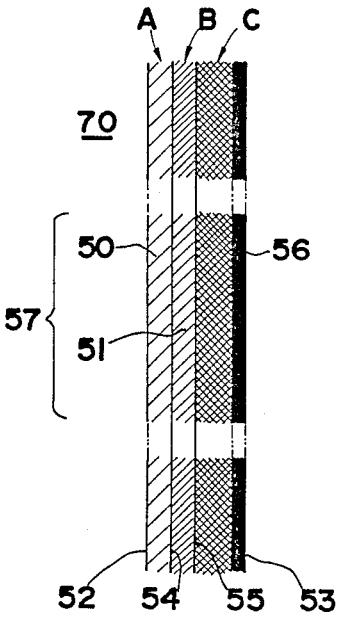
FIG. 4 is a top view showing a grid configuration of a second embodiment.
Figure 5:
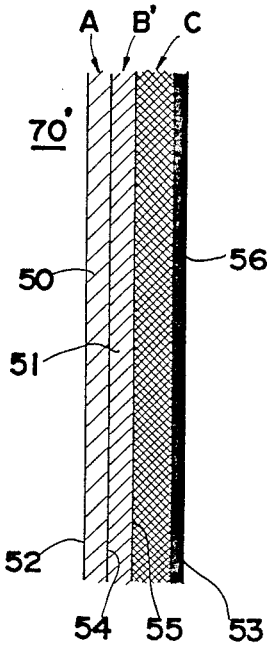
FIG.5 (PRIOR ART)
FIG. 5 is a top view showing a conventional grid configuration for the purpose of comparison.

The grids 70 and 70' will be explained prior to the details of the result of the second experiment. Both grids are divided into three portions as shown in FIGS. 4 and 5 in the paper transport direction, each portion having different aperture efficiency. The portion at the most upstream side in the paper transport direction is the greatest of the three. Accordingly, the aperture efficiency at the upstream side of the grids 70 and 70' is greater than that of the grids 7 and 7' used in the first embodiment, with the result that the copy paper can be separated at more upstream side in the case of using the grids 70 and 70' than in the case of using the grids 7 and 7'. Therefore, the improved separability can be obtained.

The grid 70' in the comparative experiment has an entire width of 16.5 mm and is divided into three portions, each having different aperture efficiency as described above. The most upstream portion (A) in the paper transport direction is formed with wire lines 50 having a width of 0.1 mm and arranged parallel to each other at an interval of 3 mm. Further, the wire lines 50 are inclined at an angle of 45° with respect to the paper transport direction. The central portion (B') is formed with wire lines 51 having width of 0.1 mm and arranged parallel to each other at an interval of 2 mm. This wire lines 51 are also parallel to the wire lines 50. The most downstream portion (C) in the paper transport direction is formed with wire lines 56 of a mesh type arranged at an inclination of 45° with a space of 1 mm. The upstream end of the grid 70' is provided with a wire line 52 having a width of 0.5 mm and the downstream end thereof with a wire line 53 having a width of 2 mm. Disposed at 4 mm and 8 mm from the upstream end thereof are reinforcement wire lines 54 and 55 respectively, each having a width of 0.1 mm and serving as a boundary of each portion.

On the other hand, the grid 70 according to the present invention is identical with the grid 70' in its configuration and mesh pattern except for a central portion (B). The grid 70 has an area 57 located centrally in the direction perpendicular to the paper transport direction and having a width of 160 mm. The central portion (B) of the grid 70 is formed with wire lines 51 arranged parallel to each other at an interval of 1 while in the area 57, the interval of wire lines 51 is set to 2 mm.

These grids 70 and 70' are mounted to the housing 5 with the wire line 52 put along the center partition 4.

Table 2 illustrates the result of the second experiment which was evaluated in the same manner as the first experiment.

TABLE 2

| Type | Grid 7' | | | Grid 7 | | |
|---|---|---|---|---|---|---|
| | Mark | | Separa- | Mark | | Separa- |
| $V_T$(KV) | Center | Edge | bility | Center | Edge | bility |
| 4.0 | N | N | B | N | N | B |
| 4.5 | N | N | E | N | N | E |
| 5.0 | N | N | E | N | N | E |
| 5.5 | N | Y | E | N | N | E |
| 6.0 | N | Y | E | N | N | E |
| 6.5 | Y | Y | E | Y | Y | E |

From the results of the first experiment using the grid 7' and the second experiment using the grid 70', it was understood that an excellent separability could be obtained by varying the aperture efficiency of the grid in the paper transport direction. However, the grid 70' cannot sufficiently eliminate the "mark" phenomenon.

Compared with the grid 70 embodying the present invention with the grid 70', the "mark" did not occur in the case of using the grid 70 even if the grid 70 was applied with a voltage in a wide range. Further, it was observed that copy paper was smoothly separated with the use of the grid 70 according to the present invention. In other words, the most desirable effect can be obtained from the grid having an aperture efficiency varied in the paper transport direction as well as the direction perpendicular to the paper transport direction.

Figure 6:
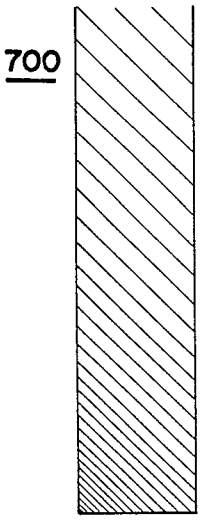
FIG. 6 is a top view showing another example of the present invention.

Since the first and second experiments were performed by feeding A4 size copy paper in the direction perpendicular to the longitudinal direction of the paper, the length of the central portions 25 and 57 of the grid were set as described above. However, this length should be determined from the size and degree of curl of copy paper to be used. In general, various size of copy paper is transported, so that it is preferable to use a grid 700 shown in FIG. 6 in which intervals of wire lines are gradually altered.

In the case of one-side reference for feeding in which one side plate of a cassette accommodating copy paper defines a reference position for feeding copy paper, the curl at the edge portion much affects to the paper having a greater width in the direction perpendicular to the paper transport direction. Therefore, supposing that copy paper having a width greater than about 180 mm which is a size of B5 copy paper in the widthwise direction is now transported with oneside reference, the portion at about 40 mm from the reference position is considered to be an edge portion. Consequently, the grid is manufactured to have a small aperture efficiency at this edge portion. On the other hand, the portion of the paper from 40 mm to 140 mm from the reference position is assumed to be a central portion, so that the corresponding portion of the grid is formed to have a great aperture efficiency. Moreover, since the portion outside 140 mm from the reference position is considered to be another edge portion, the wire lines of the grid may be arranged at an interval gradually reducing toward the another edge portion.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A paper separation charger for use in electrophotographic copiers for separating paper from a photosensitive member, comprising:

a corona wire for discharging electric charges;

a housing enclosing said corona wire and having an aperture portion at a side thereof facing said photosensitive member; and a grid member disposed at said aperture portion for regulating the amount of the electric charges travelling toward said photosensitive member, said grid member having an aperture efficiency which is different at a central portion thereof from side portions continuous to said central portion with respect to the direction perpendicular to the paper transport direction of said perpendicular member so as to make the separability of said side portions greater.

2. A paper separation charger as claimed in claim 1, wherein said central portion and said side portions of said grid member each comprise a plurality of parallel wire lines.

3. A paper separation charger as claimed in claim 2, wherein the interval between each said wire line of said central portion is greater than the interval between each said wire line of said side portions.

4. A paper separation charger as claimed in claim 1, wherein the aperture efficiency gradually decreases toward said side portions from said central portion in said direction perpendicular to the paper transport direction of said photosensitive member.

5. A paper separation charger as claimed in claim 1, wherein said aperture efficiency is greater at said central portion than at said side portions.

6. A paper separation charger for use in electrophotographic copiers for separating paper from a photosensitive member, comprising:

an electrode means for discharging electric charges, a housing enclosing said electrode means and having an aperture portion at a side thereof facing said photosensitive member; and a grid member disposed at said aperture portion for regulating the amount of the electric charges travelling toward said photosensitive member, said grid member forming a gap with said photosensitive member through which the paper passes, said grid member having a first area at a central portion thereof and second areas adjacent to said first area at side portions thereof, said first area having an aperture efficiency greater than said second areas with respect to the direction perpendicular to the paper transport direction, and said first area having a width narrower than the width of permissible minimum size paper.

7. A paper separation charger as claimed in claim 6, wherein said grid member further has a third area adjacent to both said first and second areas in the paper transport direction.

8. A paper separation charger as claimed in claim 7, wherein said first and second areas each comprise a plurality of parallel wire lines.

9. A paper separation charger as claimed in claim 7, wherein said third area has a uniform aperture efficiency in said direction perpendicular to the paper transport direction.

10. A paper separation charger as claimed in claim 7, wherein said third area comprises a plurality of parallel wire lines.

11. A paper separation charger as claimed in claim 6, wherein the aperture efficiency gradually decreases toward said second area from said first area in said direction perpendicular to the paper transport direction.

12. A paper separation charger for use in electrophotograhic copiers for separating paper from a photosensitive member, comprising:

a corona wire for discharging electric charges;

a housing enclosing said corona wire having an aperture portion at a side thereof facing said photosensitive member; and a grid member disposed at said aperture portion for regulating the amount of the electric charges travelling toward said photosensitive member, said grid member having a first area at a side portion thereof and a second area adjacent thereto, said first area having an aperture efficiency finer than said second area with respect to the direction perpendicular to the paper transport direction of said photosensitive member.

* * * * *